US006435288B1

(12) United States Patent
Dobran et al.

(10) Patent No.: US 6,435,288 B1
(45) Date of Patent: Aug. 20, 2002

(54) ROCK DRILL BIT

(75) Inventors: Mauro F. Dobran; Kerry C. Willett, both of Manitoba; Dino L. Ryan, Ontario, all of (CA)

(73) Assignee: Cubex Limited, Winnipeg (CA)

( * ) Notice: Subject to any disclaimer, the term of this patent is extended or adjusted under 35 U.S.C. 154(b) by 17 days.

(21) Appl. No.: 09/664,222

(22) Filed: Sep. 18, 2000

(51) Int. Cl.[7] ..... E21B 10/38
(52) U.S. Cl. ..... 175/393; 175/417
(58) Field of Search ..... 175/393, 400, 175/417, 418, 419

(56) References Cited

U.S. PATENT DOCUMENTS 3,455,402 A * 7/1969 Tiraspolsky ..... 175/327
3,955,635 A 5/1976 Skidmore
4,069,880 A * 1/1978 Johnstone et al. ..... 175/410
4,730,682 A * 3/1988 Ditzig ..... 175/393
5,025,875 A 6/1991 Witt
5,358,063 A * 10/1994 Hedlund et al. ..... 175/417
5,794,728 A 8/1998 Palmberg
5,890,551 A 4/1999 Liljebrand et al.

* cited by examiner

*Primary Examiner*—William Neuder
(74) *Attorney, Agent, or Firm*—Adrian D. Battison; Micheal R. Williams

(57) ABSTRACT

A rock drill bit comprising a main body arranged to drill at the end of a shaft of the drilling assembly, the main body having a diameter larger than that of the shaft, a front face on the main body arranged to engage an area for drilling and an outer surface extending rearwards from the front face. A flush channel extends through the main body to the front face and at least one open end of the flush channel at the front face is arranged to provide a fluid to an area at the front face. A plurality of contact points on the front face for engaging the area. A flush groove extends from the open end of the flush channel outwards to the outer surface and at least one relief bore extends from the front face rearwards to a relief area behind the outer surface for providing a release for the fluid from the front face to the relief area. The relief bore is located within the flush channel between the open end and the outer surface such that the debris is flushed from the drilling area to an area behind the main body.

8 Claims, 3 Drawing Sheets

ROCK DRILL BIT

FIELD OF THE INVENTION

The present invention relates to a rock drill bit.

BACKGROUND

As well known in the art of down the hole drilling using percussive type drills, the removal of debris extracted from the ground by a drill bit is important. There are many different varieties of arrangements which provide the necessary removal of the debris. It is very important while drilling that the materials cut from within the drilling area are removed therefrom such that the drill bit surface has minimal wearing therefrom. Flow paths are commonly found on drill bits for the removal of the debris. If the debris is not flushed from the drilling area there is a good chance that the drill will lock and have to be extracted from the hole which causes expensive down time.

Some examples of these types of drill bits which include flow paths or flush channels are shown in U.S. Pat. No. 5,890,551 (Liljebrand et al.) which provides a drill bit with a particular arrangement of recesses and agitators. Also there is provided a flushing channel which is arranged to flush the debris from the drilling area. U.S. Pat. No. 5,358,063 (Hedlund et al.) shows a drill bit, very similar to that of the above mentioned Patent but differs in that there is disclosed a flushing channel with an increased cross sectional area in comparison to the above mentioned Patent of Liljebrand. U.S. Pat. No. 5,794,728 (Palmberg) also shows a very similar drill bit to that shown in Liljebrand but has an arrangement of flush grooves which carry a larger volume of debris.

U.S. Pat. No. 3,955,635 (Skidmore) shows a drill bit which has provides flush grooves which can remove an even larger volume of debris than provided in the above mentioned patents. There is however, no second channel is shown for extracting the debris through the main body of the Patent.

U.S. Pat. No. 5,025,875 (Witt) provides a drill bit with secondary flush channels which divert some of the air and water mixture flushed through the flush channels to the sides of the bit but does not disclose a secondary relief channel for flushing out the debris.

These above mentioned patents do not however provide a specific arrangement of channels designed for increased relief from the pressure of the debris being flushed by the air and water mixture.

SUMMARY

According to the present invention there is provided a rock drill bit comprising:

- a main body arranged to drill at the end of a shaft of the drilling assembly, the main body having a diameter larger than that of the shaft;
- a front face on the main body arranged to engage an area for drilling;
- an outer surface extending rearwards from the front face;
- a flush channel extending through the main body to the front face;
- at least one open end of the flush channel at the front face which is arranged to provide a mixture of air and water to an area at the front face;
- a plurality of contact points on the front face for engaging the area;

- a flush groove extends from the open end of the flush channel outwards to the outer surface; and,
- at least one relief bore extending from the front face rearwards to a relief area behind the outer surface for providing a release for the mixture of air and water from the front face to the relief area;
- the relief bore is located within the flush channel between the open end and the outer surface such that the debris is flushed from the drilling area to an area behind the main body.

Conveniently a conical joining portion is located between the main body and the shaft and increases in diameter from the shaft to the main body.

Conveniently the relief bore exits are the conical joining portion.

Preferably the relief bore is at an angle relative to the flush groove.

Preferably there is two relief bores.

Preferably there is two flush grooves each having a relief bore extending therefrom.

Preferably there is a plurality of recesses at an outer edge of the front face.

Conveniently the flush grooves go to a respective recess.

Preferably the relief bore exits the outer surface of the main body between two recesses.

BRIEF DESCRIPTION OF THE DRAWINGS

In the accompanying drawings, which illustrate an exemplary embodiment of the present invention.

DETAILED DESCRIPTION

Figure 1:
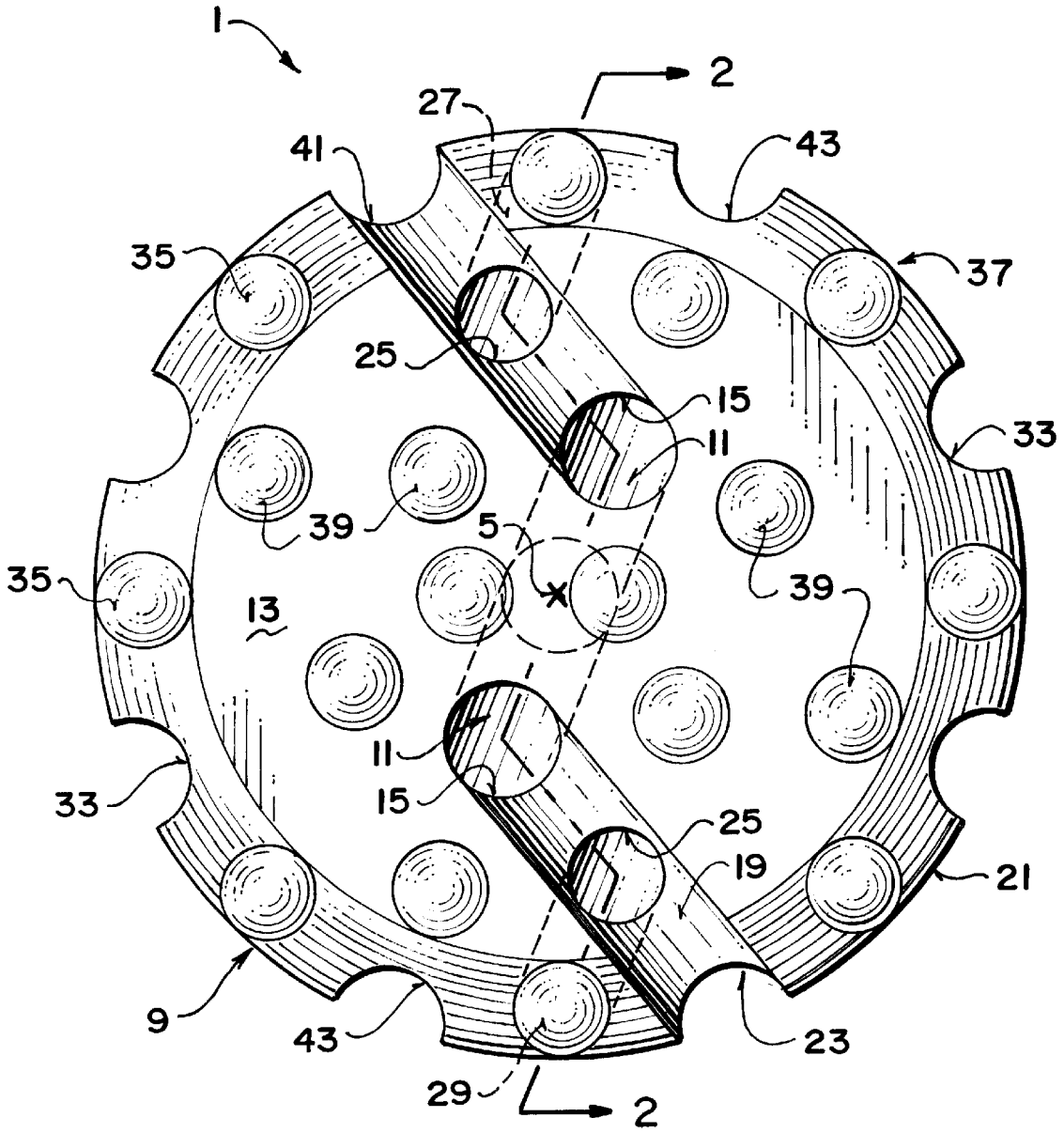
FIG. 1 is a top view of the present invention.
Figure 2:
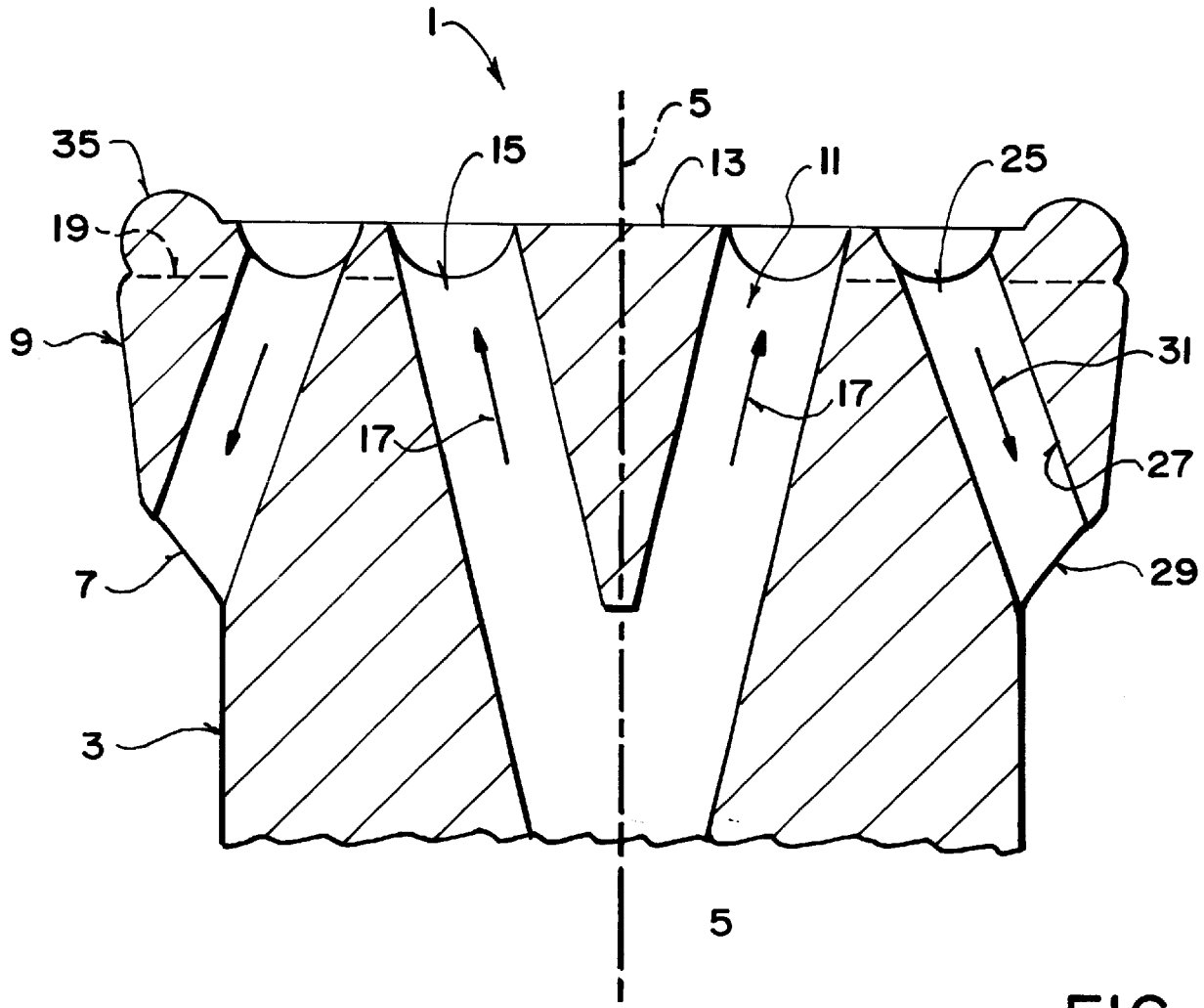
FIG. 2 is a vertical cross section along the lines 2—2 of FIG. 1.
Figure 3:
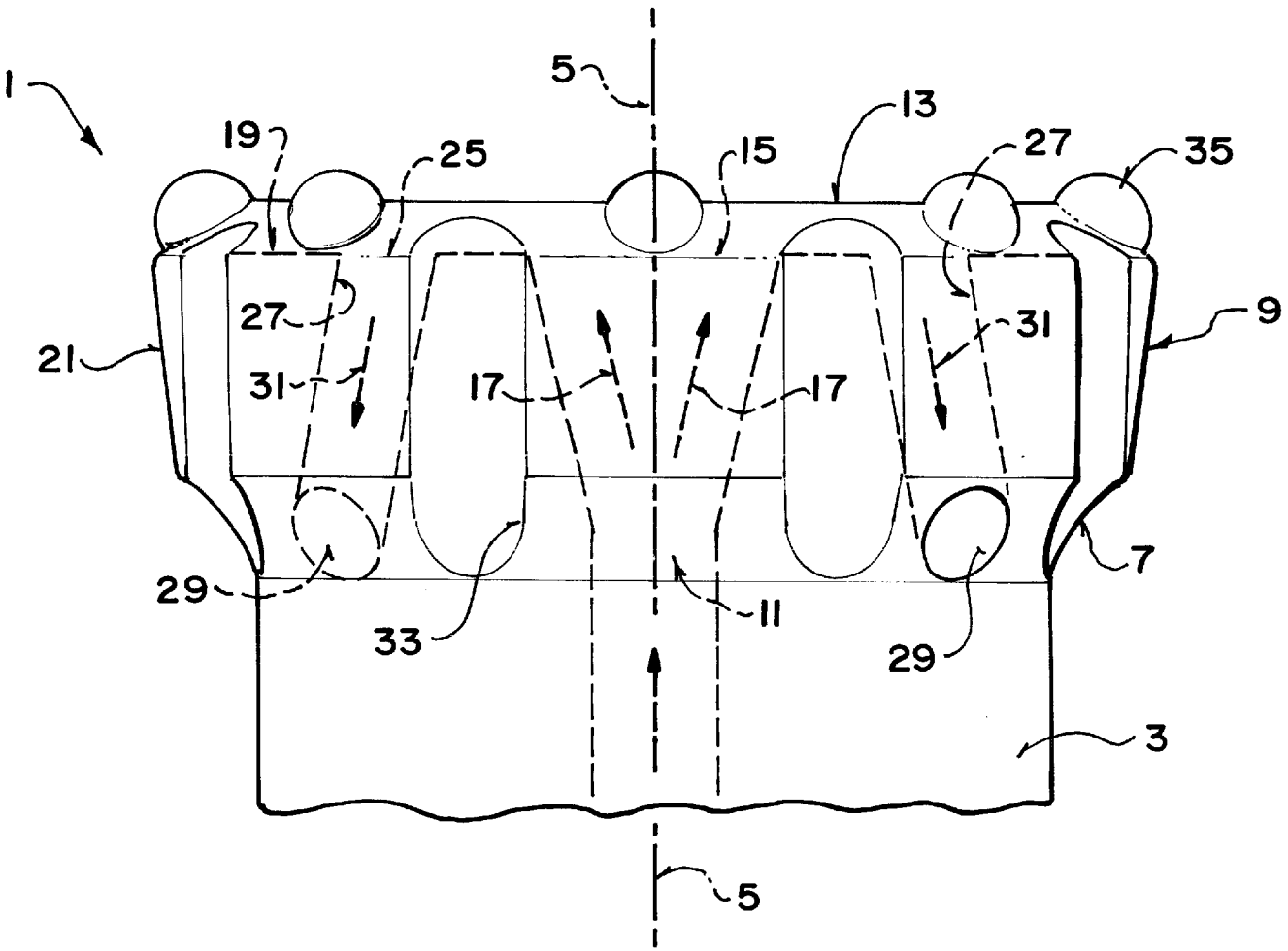
FIG. 3 is a side elevational view of the present invention.

Referring to the accompanying drawings, there is illustrated a drill bit 1. The drill bit is arranged to be located at the end of a drilling assembly for drilling or down-the-hole drilling. The drill assembly is a percussive drill that uses a hammering action within a shaft 3 which forces the drill bit through a surface, as well known in the art. The surface generally includes rock formations and/or other formations of the like. The drill bit will provide a user with an improved drill which lessens down time of the drill, which will be discussed later.

The shaft or rod string is cylindrical in shape and elongate such that sections are positioned down a hole such that the drill bit can drill into the surface.

The drill bit is located at an end of the shaft and has a larger diameter than the shaft. The shaft and the drill bit are coaxial and have an axis 5. A conical joining portion 7 is located where the drill bit and the shaft connect. The joining portion has an increasing diameter from the shaft to the bit. A head portion 9 on the bit is designed with a plurality of different functional parts, described later. The head portion is arranged to drill into the ground and is designed to flush the debris from the drilled materials rearwards to the shaft such that the debris is removed from the drilling area. A first arrangement is the larger diameter of the head portion in relation to the shaft. The head portion drills a hole which has a diameter larger than the shaft such that the said debris has an area to be located within for removal or such. A second arrangement consists of a flushing channel 11.

The flushing channel is located within the shaft and exits the head portion on a front surface 13 thereof and extends along the axis. A mixture of air and water is forced through the channel, as indicated in a flushing direction arrow 17, which thereby exits at the front surface such that the debris is forced from the front surface to the area in the hole around the shaft. The flushing channel separates within the head portion such that the mixture of air and water exits two flushing holes 15 at the front surface, as described later in detail.

A third arrangement is designed to provide a release for the debris forced away from the front surface by the air and water mixture. This arrangement consists of flushing grooves 19 which extend from each flushing hole outwardly and have an exit 23 at an outer surface 21 of the head portion, discussed in more detail later.

The above mentioned arrangements are well known in the art.

A fourth arrangement, which provides the advantage over other arrangements, consists of relief holes 25 which are located within the flushing grooves and have a channel 27 which extend to an exit 29 at the joining portion for an added relief of the debris. The relief channel provides the debris with a direction, generally indicated at 31, to travel to be removed from the drilling area. The relief channel provides the drill bit with constant flushing capability regardless of gauge wear. Eliminates hydraulic lock caused by having too much debris in the air and water mixture thus relieving stress and energy recoil to rod string and drill. Allows a user to use 4" diameter rods for hole accuracy and up hole velocity. The bit is not limited to using 4" diameter rods. The bit enables a user to use any standard sized rods but the use of 4" diameter rods is solely mentioned as an advantage. Reduces grinding intervals on gauge and flushing grooves. Decreases amount of torque on top drive caused by small diameter bits approaching same diameter as rods and hammer. As well as possible elimination of the accumulators dues to noticeable decrease in rod and hose vibration when 4¾ rock bits are used, which have larger flushing grooves than the general bit, therefore using bits with smaller flushing grooves.

The head portion is substantially cylindrical and has a larger diameter than the diameter of the shaft and has a flat front surface. A plurality of recesses 33 are positioned on an outer edge of the front surface which provide another area for release of the debris.

The front surface has an arrangement of agitators spaced apart and positioned to break up the ground in the drilling area. A first arrangement of agitators 35, defining an outer ring 37, are spaced equidistantly apart angularly about the axis on the front surface. A second arrangement of agitators 39 are spaced randomly on the front surface within the outer ring.

The flush holes exit the front surface on respective sides of the axis and are offset and inline with opposing recesses 41. The flush groove angles from a respective flush hole to the next opposing recess 43 such that the grooves are trailing in respect to the direction of rotation relative to each respective flush hole.

Each relief hole is located within each flush groove such that the debris forced along the flush groove by the mixture of air and water pumped through the flush channel is directed therethrough and exits through the relief channel at the joining portion. The relief channels extend through the head portion and exit at the conical joining portion between the first opposing recess 41, and the second opposing recess 43, respectively.

While one embodiment of the present invention has been described in the foregoing, it is to be understood that other embodiments are possible within the scope of the invention. The invention is to be considered limited solely by the scope of the appended claims.

What is claimed is:

1. A rock drill bit comprising:

a main body arranged to be attached at the end of a shaft of a drilling assembly, the main body having a diameter larger than that of the shaft;

the main body having a front face arranged to engage an area for drilling;

the main body having an outer surface extending rearwards from the front face and defining a recessed relief area of reduced diameter spaced from the front face and adjacent the shaft;

a flush channel extending through the main body to the front face;

the flush channel having at least one open end of the flush channel at the front face which is arranged to provide a flushing fluid from the shaft to an area at the front face;

a plurality of contact points on the front face for engaging the area;

at least one flushing groove extending along the outer surface from the front face to the recessed relief area for communicating flushing fluid from the front face for return along an outside of the shaft and, at least one relief bore extending through the main body from a mouth on the front face spaced inwardly from the outer edge rearwards to the recessed relief area behind the outer surface for providing a release for the fluid from the front face to the recessed relief area.

2. The drill bit according to claim 1 wherein there is provided a groove in the end face extending from the open end of the flush channel outwards to the outer surface and wherein the relief bore has a discharge mouth located within the groove in the end face.

3. The drill bit according to claim 1 wherein the recessed relief area defines a conical joining portion which is located between the main body and the shaft and increases in diameter from the shaft to the main body.

4. The drill bit according to claim 3 wherein the relief bore exits from the main body at the conical joining portion.

5. The drill bit according to claim 1 wherein there are two relief bores.

6. The drill bit according to claim 1 wherein there are provided two grooves in the end face each extending from a respective open end of the flush channel outwards to the outer surface and wherein there are two relief bores each extending from a respective one of the grooves in the end face to the recessed relief area.

7. The drill bit according to claim 1 wherein there is a plurality of flushing grooves at angularly spaced positions around the outer surface at an outer edge of the front face.

8. The drill bit according to claim 7 wherein the relief bore exits the main body at a location between two of the flushing grooves.

* * * * *